US006073530A

United States Patent [19]

Dombkowski

[11] Patent Number: 6,073,530

[45] **Date of Patent: *Jun. 13, 2000**

[54] RULE GUARD

[75] Inventor: John A. Dombkowski, West Springfield, Mass.

[73] Assignee: City Stamp Works, Inc., Ludlow, Mass.

[ * ] Notice: Under 35 U.S.C. 154(b), the term of this patent shall be extended for 197 days.

[21] Appl. No.: 08/642,850

[22] Filed: May 6, 1996

[51] Int. Cl.[7] ..... B26D 1/12

[52] U.S. Cl. ..... 83/698.41; 83/347; 83/659; 83/663; 83/698.42

[58] Field of Search ..... 83/659, 663, 698.41, 83/698.42, 347, 691, 698.71, 618

[56] References Cited

U.S. PATENT DOCUMENTS

| | | | |
|---|---|---|---|
| 3,885,486 | 5/1975 | Kirkpatrick et al. | 83/659 |
| 4,012,978 | 3/1977 | De Lanauze | 83/698.41 |
| 4,075,918 | 2/1978 | Sauer | 83/659 |
| 4,187,752 | 2/1980 | Chestnut | 83/663 |
| 4,848,204 | 7/1989 | O'Connor et al. | 83/698.42 |
| 4,867,024 | 9/1989 | Cho et al. | 83/698.42 |
| 5,194,064 | 3/1993 | Simpson et al. | 83/879 |

*Primary Examiner*—Kenneth E. Peterson
*Assistant Examiner*—Sean Pryor
*Attorney, Agent, or Firm*—Ross, Ross & Flavin

[57] ABSTRACT

A dual purpose rule guard for two-piece rotary cutting dies consists of a pair of confrontable allochiral guards. Each defines on its confronting surface a first portion thereof recessed inwardly therefrom and a second portion thereof projecting outwardly therefrom. The guards of the pair are interdigitable for assuming an interlocked position with respect to each other to insure the correct alignment of the cutting dies and of their rules. Additionally, each guard is so positioned relative to its cutting die that its second outwardly projecting portion projects outwardly of the confrontable edge or join line of the cutting die so that it functions as an overhang to keep the knife at the join line upwardly and away from any storage surface.

2 Claims, 2 Drawing Sheets

RULE GUARD

BACKGROUND OF THE INVENTION

The invention relates to a two-piece rotary cutting die and its associated rules or cutting blades.

More particularly it relates to a means for insuring easy and accurate rule alignment as well as for insuring against rule damage while the die boards are in any storage position on a floor, shelf, die rack or other storage surface.

Steel rule dies are used for shaping and cutting sheet material, usually corrugated board, into preformed blanks from which various types of containers and the like are subsequently formed.

The cutting dies are usually arcuate, the obtainable production rates being higher than with flat cutting dies.

With a rotary cutting die machine, a pair of cylinders are mounted in a supporting frame with a predetermined gap therebetween.

One of the cylinders, usually the upper one, carries a die plate or board, or a pluarlity of die plates or boards, mounting the appropriate cutting rules (and sometimes perforating rules and creasing rules).

The other cylinder normally mounts a yieldable layer of a plastic material which supports the corrugated board as it is fed between the cylinders during their cooperative rotative movements.

Each of the steel rule dies must be fabricated with care and according to a specific particular application.

An arcuate die plate or plural die plates are provided on which is laid out the appropriate shape, or partial shape, of the blank desired, including lines for cuts, perforations and folds, the layout for the die plate being prepared by a special layout machine which compensates for the arcuate shape of the die plate to provide the proper spacings between the cutting or other rules as they will appear on the arcuate configuration of the conventional plate.

Cuts are then made in the die plate along the particular layout lines in the provision of properly located slots for the reception of the cutting, perforating and creasing rules.

These slots will be discontinuous to allow for continuity at the slot ends between adjacent confronting portions or sections of die plates.

The lower arcuate edges of the steel rules seat against the die cylinder so that the upper edges of the steel rules are a given distance upwardly from the cylinder.

The die plate is made with a precise radius of curvature equal to that of the die cylinder on which it is mounted so that a true fit is achieved and the radius of the plate is not changed as it is tightened down on its cylinder.

Countersunk holes are provided in the die plate through which fasteners can be extended to affix the plate to the die cylinder.

DESCRIPTION OF THE PRIOR ART

No reference has been found which anticipates the features of insuring accurate alignment between adjacent confronting cutting dies and/or of insuring the protection of the ends of the cutting dies while in any storage position.

SUMMARY OF THE INVENTION

The rule guard is for the insuring the alignment of two-piece rotary cutting dies and their rules. It teaches a pair of confrontable allochiral guards, each defining on its confronting surface a first portion thereof recessed inwardly therefrom and a second portion thereof projecting outwardly therefrom. The guards of the pair are interdigitable for assuming an interlocked position with respect to each other and in so doing insure the proper alignment of the dies and more particularly of their rules.

The rule guard insures the protection of the two-piece rotary cutting dies. In the case of the pair of confrontable allochiral guards, each guard is so positioned relative to its cutting die that its second outwardly projecting portion projects outwardly of the confrontable edge or join line of the cutting die, wherefor it serves as an overhang so as to keep the knife at the join line upwardly and away from any flooring, shelving or storage surface.

DESCRIPTION OF THE PREFERRED EMBODIMENT

Figure 1:
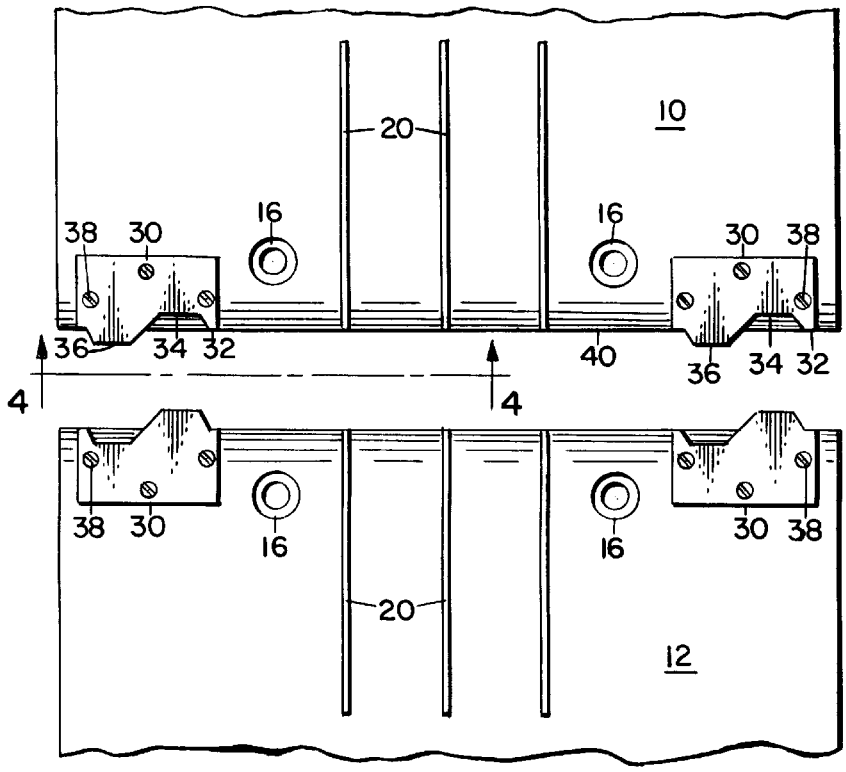
FIG. 1 is an exploded, fragmentary view in top plan of a pair of die plates in a separated position.
Figure 2:
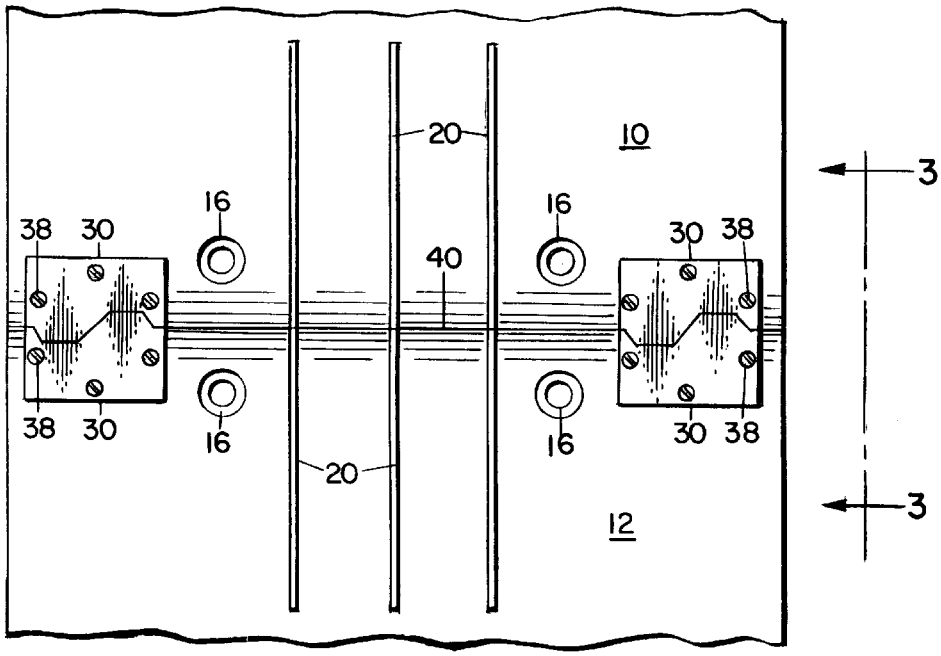
FIG. 2 is an exploded, fragmentary view, similar to FIG. 1, and showing the die plates in an interlocked position as to each other.
Figure 3:
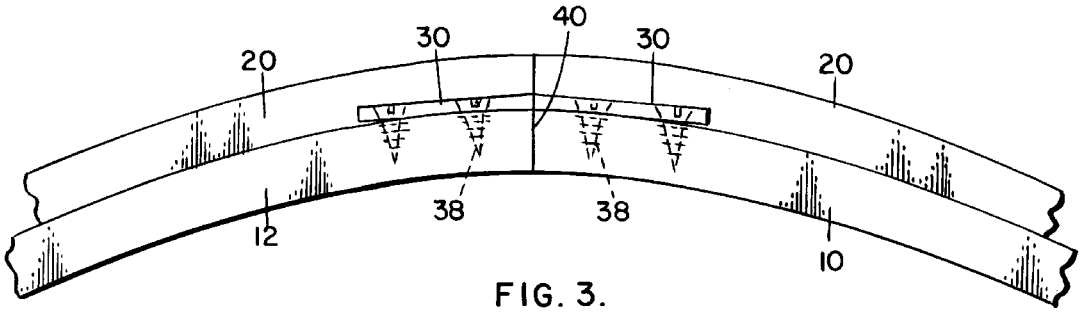
FIG. 3 is an enlarged, fragmentary view, in end elevation on the line 3—3 of FIG. 2.
Figure 4:
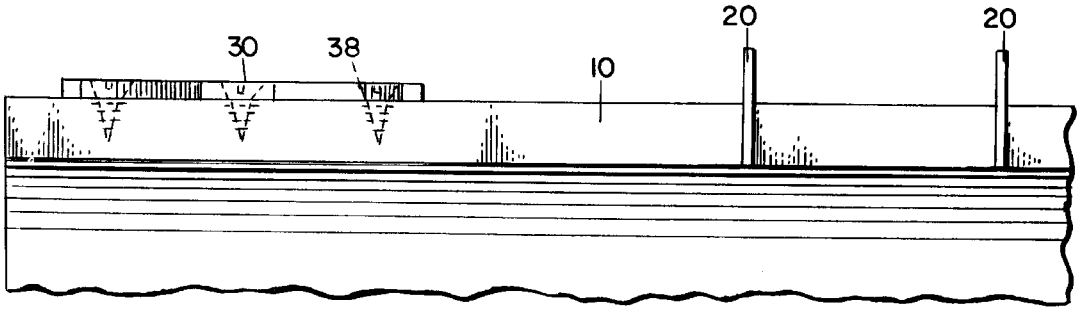
FIG. 4 is an enlarged, fragmentary view, in end elevation on the line 4—4 of FIG. 1.
Figure 5:
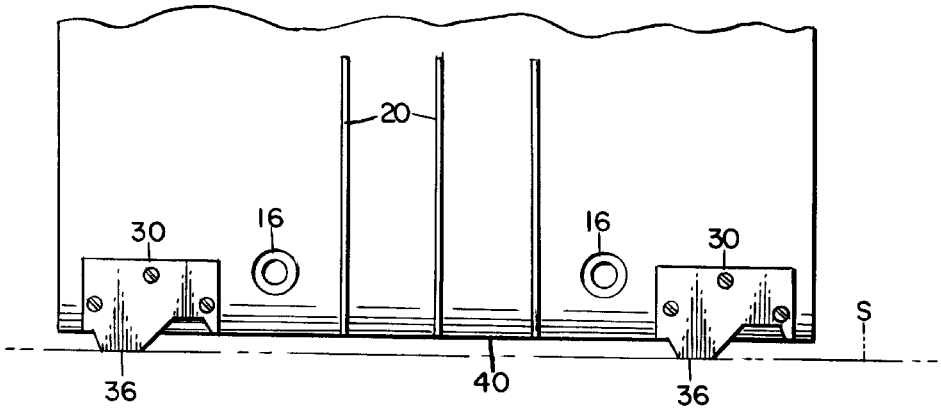
FIG. 5 is a fragmentary view, in front elevation, showing the rules of one of the die plates supported in a spaced storage position upwardly of a shelf, table or the like upon which it rests.

In the drawings, I have shown, fragmentarily in FIGS. 1 and 2, a pair of arcuate die plates or boards 10 and 12 which are mounted on a cylinder, being held relative thereto as by fasteners which are extended through countersink holes 16.

Portions of rules or knives 20 are shown on each of the die plates.

While the die plates are shown, in so-called exploded positions, it is to be understood that when mounting same on a cylinder, the die plates may be positioned in the adjacency, as shown in FIG. 2, and with the desideratum that confronting rules be positioned in accurate alignment with each other.

To ensure this collinearity, meaning the passing of confronting rules through the same straight lines with their axes lying end-to-end in continuous straight lines, I provide pairs of guards represented by 30, each defining on its inboard or confronting surface 32 a portion 34 recessed inwardly therefrom and a portion 36 projecting outwardly therefrom.

The guards of a pair are allochiral in configuration. That is, they are similar or correspondent or identical in form as the right hand is to the left and the respective portions are arranged in reverse order. They are symmetrically alike, with the portions being reversed in position and arrangement as to right and left as in the case of one's hands.

The guards of a pair are thus interdigitable so as to assume an interlocked position when secured by means of screws 38 or the like to the confronting edges of adjacent die boards, the outwardly projecting portions 36 extending outboard of the plane of the end edge surface 40 of the respective die board.

The strategic positioning of the guard such that its outwardly projecting portion 36 is outboard of the plane of the end edge surface 40 of the die plate provides an overhang of such dimension that when the arcuate die plate is removed from its supporting cylinder and placed in a storage position, as on a shelf S or the like, the overhang serves to project the die plate slightly upwardly from the shelf for the obvious protection of the ends of any rule extended to that end edge surface.

I claim:

1. In a two-piece arcuate die plate mounted in confrontation collinearly on a cylinder with segments of a rule mounted in similar collinearity on each of the confronting pieces of the die plate, the improvement for insuring the aligning of the pieces of the die plate and of the respective segments of the rule consisting of:

a pair of symmetrical line-up guides allochiral in configuration with each having a joint line coincident with the confrontable edge of a respective piece of the die plate and defining along said joint line a first portion recessed inwardly from the joint line and a second portion thereof projecting outwardly from the joint line, the line-up guides of the pair being disposed reversely as to each other, each line-up guide being strategically mounted on a respective one of the pieces of the die plate in interdigitated relationship with the other line-up guide for insuring the aligning of the pieces of the die plate and the collinearity of the segments of the rule.

2. In the die plate of claim 1, the improvement further consisting of, each line-up guide being so positioned relative to its piece of die plate that its second outwardly projecting portion projects outwardly from its joint line in defining an overhang for keeping the end of the segment of the rule at the joint line upwardly and distantly of any surface upon which the die plate piece may be disposed for storage purposes.

* * * * *